US006450002B1

(12) United States Patent
Smith

(10) Patent No.: US 6,450,002 B1
(45) Date of Patent: Sep. 17, 2002

(54) COMPACT APPARATUS FOR GROOVING A TUBE AND METHOD FOR GROOVING A TUBE

(76) Inventor: Robert S. Smith, 782 NE. 37th St., Oakland Park, FL (US) 33334

( * ) Notice: Subject to any disclaimer, the term of this patent is extended or adjusted under 35 U.S.C. 154(b) by 0 days.

(21) Appl. No.: 09/730,278

(22) Filed: Dec. 5, 2000

(51) Int. Cl.[7] ..... B21D 17/02
(52) U.S. Cl. ..... 72/402; 72/370.21; 29/282
(58) Field of Search ..... 72/370.21, 402; 29/282, 283.5, 237

(56) References Cited

U.S. PATENT DOCUMENTS

| | | | | | |
|---|---|---|---|---|---|
| 3,029,665 | A | * | 4/1962 | Baugh | 72/402 |
| 3,217,519 | A | | 11/1965 | Demler | |
| 3,362,212 | A | | 1/1968 | Steele et al. | |
| 4,250,733 | A | * | 2/1981 | Ruhl et al. | 72/402 |
| 4,297,868 | A | * | 11/1981 | Hunter | 72/402 |
| 4,391,458 | A | * | 7/1983 | Blakeley | 285/112 |
| 4,553,421 | A | * | 11/1985 | Provost et al. | 72/402 |
| 4,703,643 | A | | 11/1987 | Brooks et al. | 72/402 |
| 5,096,111 | A | * | 3/1992 | Ishikawa et al. | 29/234 |
| 5,799,531 | A | | 9/1998 | Orcutt et al. | 72/402 |
| 6,196,039 | B1 | * | 3/2001 | Williams et al. | 72/105 |

FOREIGN PATENT DOCUMENTS

| | | | | |
|---|---|---|---|---|
| DE | 23 59 034 | * | 5/1975 | 72/402 |

* cited by examiner

*Primary Examiner*—Daniel C. Crane
(74) *Attorney, Agent, or Firm*—Malin, Haley & Dimaggio, P.A.

(57) ABSTRACT

An apparatus for grooving a tube, comprising a stud, a partitioning ring around the central region of the stud, a mandrel, a plurality of concave jaws, an outer tapered sleeve, and a tightening mechanism. The mandrel is placed over far end of the stud, and the tube to be worked is placed on the end of the mandrel. Concave jaws with flanges are fitted into grooves around the mandrel, so that the flanges surround the tube. A tapered sleeve is placed over the near end of the stud, extending at least partially over the jaws. The tightening mechanism is then placed over the near end of the stud. Tightening of the mechanism draws the flanges on the jaws to the tube to be worked.

2 Claims, 3 Drawing Sheets

COMPACT APPARATUS FOR GROOVING A TUBE AND METHOD FOR GROOVING A TUBE

BACKGROUND OF THE INVENTION

1. Field of the Invention

This invention relates generally to a compact apparatus for grooving a tube and a method for grooving a tube.

2. Description of Related Art

The need for grooving a tube is generally known in the art of tube coupling and tube repair. Victaulic couplings are used in making joints, retrofits and repairs in tubing, both in-situ and otherwise, and require grooved tubes. A Victaulic seal is especially useful for fitting copper pipes together, in all sizes of pipe, since the seal does not use heat which can unevenly expand the pipe ends used in the repair. It is extremely difficult to form a good seal between unevenly expanded pipe ends. Moreover, a method for sealing pipes that does not require heat is safer where combustible materials are present.

To make a typical Victaulic coupling, a groove is formed around each end of a pipe. The two ends of pipe are then lined up and a rubber ring is fitted around the joint. Two semicircular bands, forming a sleeve, each of which have a ridge on both edges to fit into the groove of the pipe, are placed around the ring and are drawn together with two bolts. As the bolts are tightened, the rubber ring is compressed, making a watertight joint, while the ridges fitting in the grooves make the joint strong mechanically. In fact, as the pipe hydraulically expands, the pressure tightens the bolt, making the Victaulic coupling repair even stronger.

A tube machine is shown in U.S. Pat. No. 3,362,212 issued Jan. 9, 1968 to Steele. It describes a machine for tapering the end of a tube, bolted to a base or table and attached to a power source, thereby requiring operations to be at the site of the machine.

U.S. Pat. No. 5,799,531, issued Sep. 1, 1998 to Orcutt et al., describes a crimper fitting locator assembly. The described assembly has a hydraulic ram actuator assembly affixed to a bed plate with columns and a locating assembly mounted on a support.

An automatic crimper and crimping die is shown in U.S. Pat. No. 4,703,643 issued Nov. 3, 1987 to Brooks et al., which requires that the length of a stroke of a ram against crimping dies is controlled electrically by comparing voltages on a balancing circuit.

U.S. Pat. No. 3,217,519, issued Nov. 16, 1965 to Demler describes a coaxial crimping tool. The tool is for coaxial cable, and requires that the cable be stripped and otherwise prepared before crimping. Also, there is no adjustability of the stop pin.

Rollers are also known in the art of grooving tubes. However, rollers are expensive machines and are bulky. Generally, they require the pipes to be of a minimum size for optimum use. Furthermore, they cannot be used in in-situ repairs.

BRIEF SUMMARY OF THE INVENTION

The invention is a compact apparatus and a method for grooving a tube. The apparatus would typically be used in the field, although it may also be used in a workshop, laboratory or other location.

The invention has a stud with a partitioning ring, a mandrel, a plurality of jaws and a tightening mechanism.

The mandrel is fitted around the far end of the stud through a hole on the center of the mandrel. The mandrel has a far end with a resting place for a tube to be worked. On the near end, the mandrel has a recession complementary to the partitioning ring. The tube may be grooved in-situ; however, it may also be worked away from where it is placed.

A plurality of jaws is placed around the mandrel. The jaws have protrusions on their interior surface on their near ends that are complementary to a groove around the near end of the mandrel. The jaws also have flanges on their interior surfaces on the far end for providing the grooving on the tube to be worked.

A tapered sleeve is then placed over the near end of the stud. A tightening mechanism is placed behind the tapered sleeve on the near end of the stud. The tube to be worked is then fitted over the far end of the mandrel, resting on the resting place. As the tightening mechanism is tightened, the interior surface of the tapered sleeve interacts with the outer surface of the jaws, and the sleeve is drawn toward the mandrel. Thus, the flanges on the jaws form a groove on the tube.

In accordance with these and other objects which will become apparent hereinafter, the instant invention will now be described with particular reference to the accompanying drawings.

The prior art fails to teach a compact apparatus for the grooving of a tube such as a metal pipe. The prior art also fails to teach a compact method for in-situ repairs where there is little clearance of the pipe. In addition, the prior art fails to teach a method that is ideal for cosmetic and structurally sound Victaulic couplings, with manual control of the grooving mechanism.

DETAILED DESCRIPTION OF THE INVENTION

Figure 1:
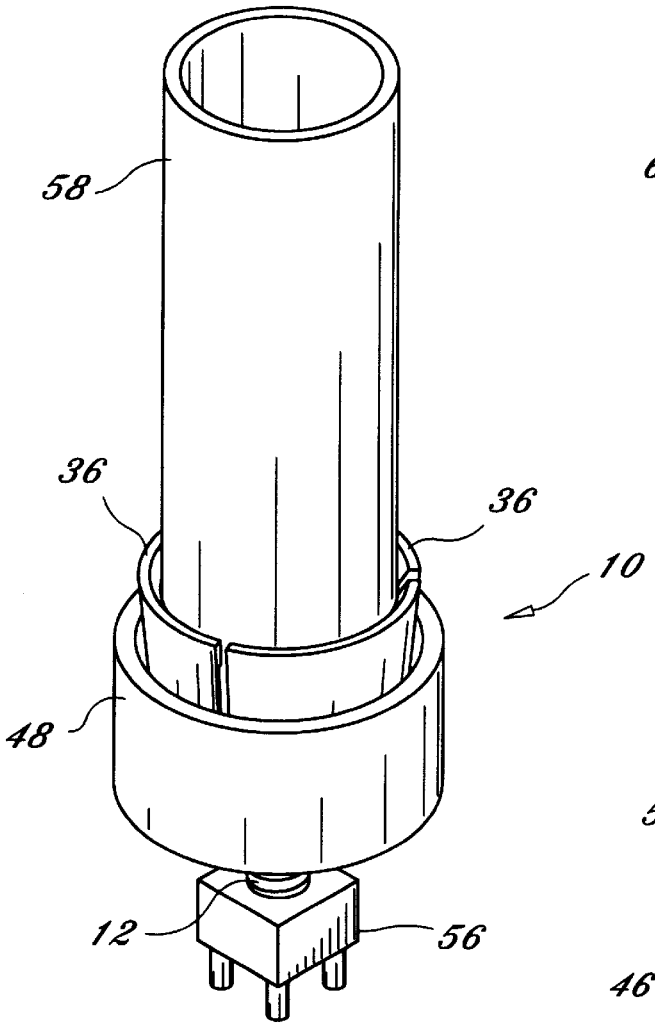
FIG. 1. is a top perspective view of the preferred embodiment of the invention with a tube to be worked.

The invention is an apparatus for forming a groove on a tube which is generally described in FIG. 1 as 10. The apparatus 10 first includes a central stud 12. Preferably the stud 12 is made of metal such as steel or is made from another suitable material. As shown more clearly in FIGS. 2 & 3, around the stud 12, in a generally central region around the stud 12, is a partitioning ring 14. The partitioning ring 14 separates the stud 12 into a near end 16 and a far end 18. The partitioning ring 14 is preferably made of metal such as steel, although other appropriate materials are known in the art. In one embodiment, the stud 12 is threaded and the partitioning ring 14 has complementary threads. Also, other alternative embodiments are contemplated. In the preferred embodiment, the partitioning ring 14 is immovable along the longitudinal axis of the stud 12. However, methods of enabling the partitioning ring 14 to be moved along the stud 12 and then fixed into position are also known in the art. In an alternative embodiment, the partitioning ring 14 is an intrinsic part of the stud 12.

Figure 4:
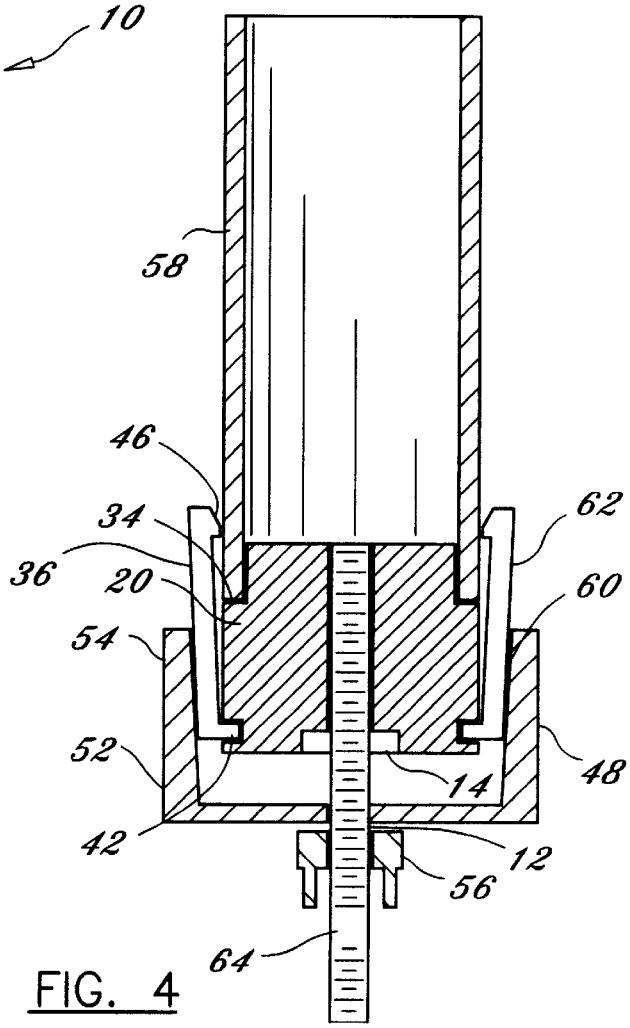
FIG. 4 is a side view cross section of the preferred embodiment with a tube to be worked.
Figure 2:
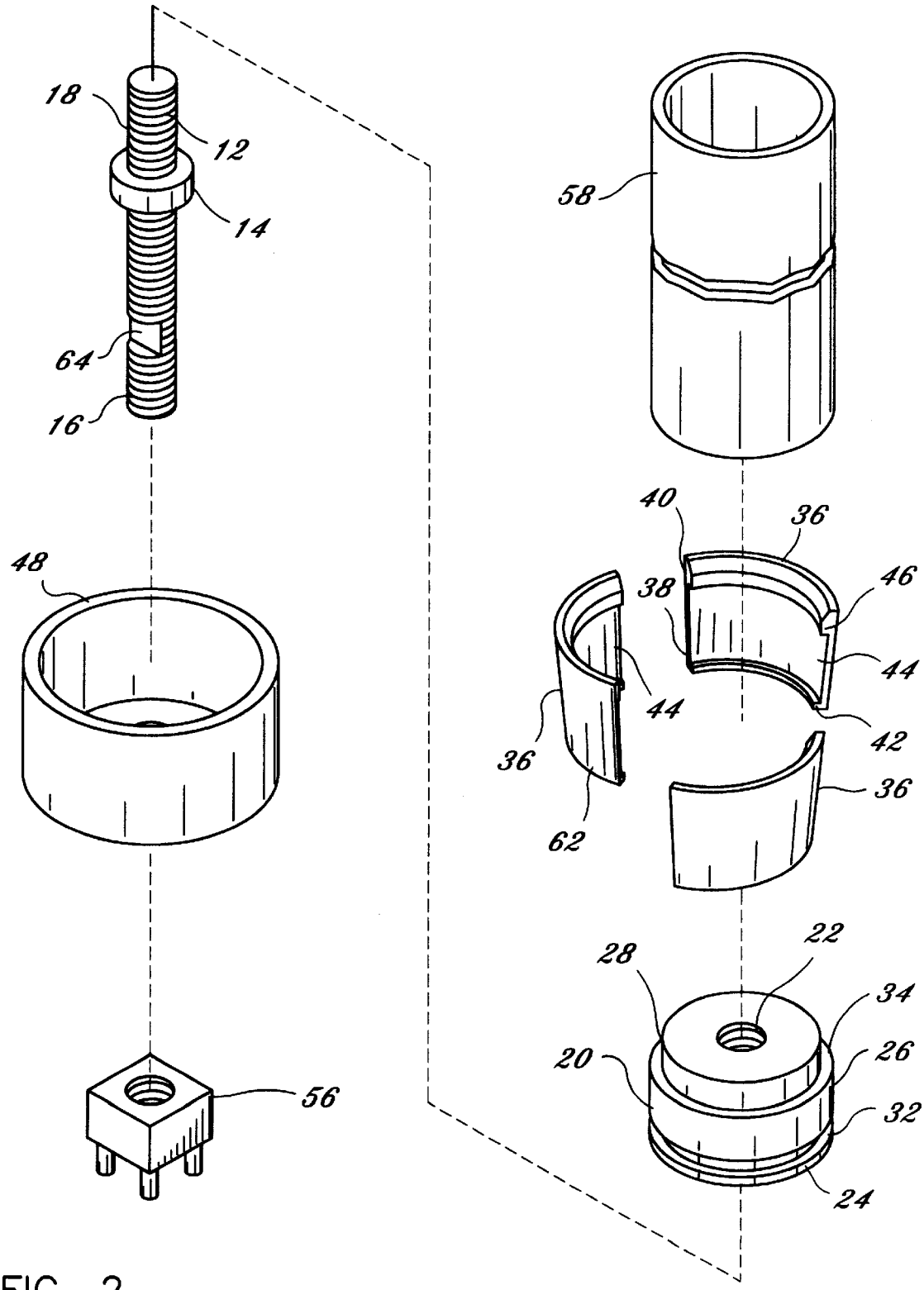
FIG. 2 is a top perspective exploded view of the preferred embodiment of the invention with a tube to be worked.
Figure 3:
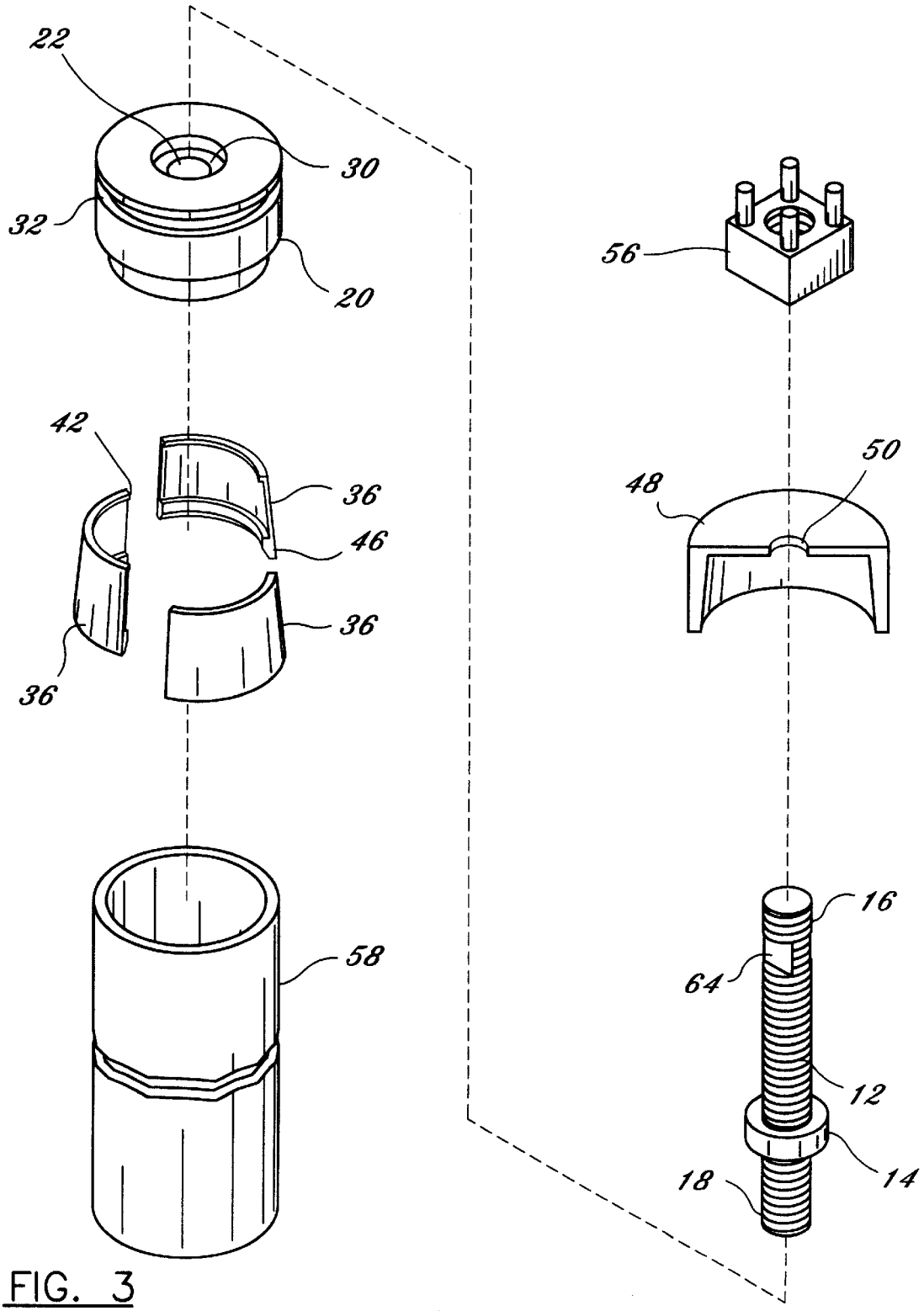
FIG. 3 is a bottom perspective exploded view of the preferred embodiment of the invention with a tube to be worked.

In one embodiment, as shown in FIGS. 2–4, the stud 12 further comprises an area 64 on the near end 16 of the stud 12 for the fitting of a removal device (not shown). In the preferred embodiment, opposite areas 64 on the stud 12 are flattened . The flattened areas 64 fit a wrench which, when turned, would loosen the apparatus 10 from the tube 58 after a groove has been formed on the tube.

Around the far end 18 of the stud 12 is a mandrel 20. Preferably, the mandrel is made of metal such as steel, although other materials are known in the art. The mandrel 20 has a central interior bore 22 with a width complementary to the stud 12. The mandrel 20 has a near end 24, a central portion 26 and a far end 28. In use, the near end 24 of the mandrel 20 is fitted over the far end 18 of the stud 12. As shown in FIG. 3, the near end 24 of the mandrel 20 comprises a central recession 30 which is complementary to the partitioning ring 14. In the preferred embodiment, the central interior bore 22 of the mandrel 20 has complementary threads to threads around the stud 12. Around the outer perimeter of the mandrel 20 at the near end 24 is a retaining groove 32.

The central portion 26 of the mandrel 20 preferably has a diameter that is approximately the width of the outer diameter of the tube 58 to be worked. An example of a tube 58 to be worked is a metal pipe, such as copper or lightweight steel, although other materials are contemplated. The central portion 26 also comprises a resting area 34 for the tube 58 to be worked. In the preferred embodiment, the resting area 34 is generally flat.

The far end 28 of the mandrel 20 has an outside diameter which is less than the inside diameter of the tube 58 to be worked. When the apparatus 10 is used, the end of the tube 58 to be worked is placed over the far end 28 of the mandrel 20. Although FIG. 4 shows a mandrel 20 that extends all the way to the end of the stud 12, the mandrel 20 may also extend beyond the stud 12, or the stud 12 may extend beyond the mandrel 20.

A plurality of concave jaws 36 is placed around the mandrel 20. Each jaw 36 has a near end 38 and a far end 40. In the preferred embodiment, each jaw 36 is tapered so that the far end 40 is wider than the near end 38. Preferably, the jaws 36 are made of metal such as steel, although other appropriate materials are also known in the art. The near end 38 of each jaw 36 comprises a protrusion 42 on the interior surface 44 that is complementary to the retaining groove 32 on the mandrel 20. The far end 40 of each jaw 36 also has a flange 46 on the interior surface 44 for forming a groove on the tube 58 to be worked.

Figure 5:
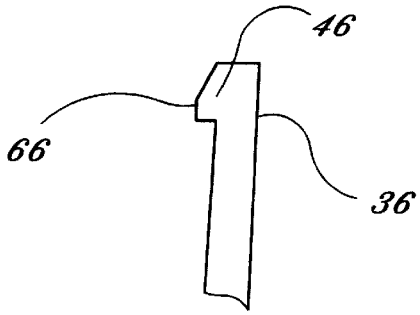
FIG. 5 is a side view of the far end of a jaw in the preferred embodiment of the invention.

Also, in the preferred embodiment, as shown in FIG. 4, when the apparatus 10 is in use, the flange 46 on each jaw 36 extends slightly above the far end 28 of the mandrel 20. Also, it is preferred that the face 66 of the flange 46 be tapered toward the far end 40 of the jaw 36, so that the flange 46 forms a distinct groove on the tube 58 when the apparatus 10 is being used. The tapering of the face 66 of the flange is generally illustrated in FIG. 5.

As shown in FIGS. 1 & 4, an outer tapered sleeve 48 is then placed over the jaws 36. Generally, in the preferred embodiment, the jaws 36 are tapered to approximately the same degree as the taper in the sleeve 48. The tapered sleeve 48 is preferably made of metal such as steel. However, other appropriate materials are also known in the art. The tapered sleeve 48 has a central bore 50 which is complementary to the width of the stud 12. In the preferred embodiment, the tapered sleeve 48 is not threaded. However, the width of the bore 50 allows the sleeve to be placed over the stud. The tapered sleeve 48 comprises a near end 52 and a far end 54. The tapering of the tapered sleeve 48 is such that the inner diameter decreases from the far end 54 to the near end 52 of the tapered sleeve 48. In use, the tapered sleeve 48 is placed over the near end 16 of the stud 12, and extends around at least a portion of the stud 12, the mandrel 20 and the jaws 36. The jaws 36 and the tapered sleeve 48 are configured so that when the tapered sleeve 48 is drawn toward the partitioning ring 14 on the stud 12, the tapered sleeve 48 will force the jaws 36 to contract. As the jaws 36 contract, the flanges 46 on the jaws 36 will cause the tube 58 to be worked to be grooved. The width of the stud 12, mandrel 20, jaws 36 and tapered sleeve 48 are such that in-situ grooving of a tube may be accomplished with a minimum of clearance between the tube to be worked and a wall or other obstruction.

The apparatus 10 also comprises a tightening mechanism 56. The tightening mechanism 56 is placed on the near end 16 of the stud 12. In the preferred embodiment, the tightening mechanism 56 is a nut with threads corresponding to the threads of the stud 12. However, other appropriate tightening mechanisms 56 are also contemplated.

As the apparatus 10 is used in its preferred embodiment, the mandrel 20 is threaded onto the far side 18 of the stud 12 with the partitioning ring 14. A central recession 30 on the mandrel 20 conforms to the width and shape of the partitioning ring 14. The plurality of jaws 36 are placed around the mandrel 20 by inserting a protrusion 42 on the interior surface 44 of the near end 38 of each jaw 36 into the retaining groove 32 on the mandrel 20. The outer tapered sleeve 48 is then placed loosely on the near end 16 of the stud 12, so that the far end 54 of the tapered sleeve 48 extends at least partially over the jaws 36. The tapered sleeve 48 helps keep the jaws 36 in place around the mandrel 20. The tightening mechanism 56 in the form of a nut is loosely threaded outside the tapered sleeve 48 onto the near end 16 of the stud 12.

A tube 58 to be worked is then placed on the mandrel 20. A tube such as a 3" copper pipe is fitted over the far end 28 of the mandrel 20, so that the end of the pipe to be worked rests upon the resting area 34 at the central portion 26 of the mandrel 20. As stated above, other tubes 58 are also contemplated by this invention.

The nut is then tightened onto the stud 12, thereby drawing the tapered sleeve 48 up to the partitioning ring 14. The inner surface 60 of the tapered sleeve 48 then forces the outer surface 62 of the jaws 36 inward, causing the jaws 36 to contract. As the jaws 36 contract, the flanges 46 on the jaws 36 contact the tube 58 to be worked, thereby grooving the tube 58. In the preferred embodiment, to loosen the jaws 36 from the tube 58, a wrench is attached to the stud 12 at the areas 64 for fitting a removal device. Other appropriate means for removing the jaws 36 from the tube 58 are known in the art and are contemplated by this invention.

The nut is then loosened or removed so that the apparatus 10 may be removed, and a Victaulic-type groove in the tube 58 remains. A second tube 58 could be grooved in the same manner, so that the distance from the end of the tube to the groove would be the same for the original tube and the second tube. Thus, when the original tube and the second tube are put together as for a Victaulic repair, uniformity in the grooving provide for a superior pipe repair cosmetically as well as functionally.

In another embodiment, the stud 12 is attached at its near end 14 to a hydraulic cylinder, such as a portable hydraulic cylinder manufactured by Greenlee used by plumbers and pipefitters. As the hydraulic cylinder draws in the stud 12, the sleeve 48 is forced toward the mandrel 20. The movement of the sleeve 48 thereby causes the flanges 46 to groove the tube 58. Spacers may be placed between the fitting on the hydraulic cylinder for the stud 12 and the stud 12 to ensure that the stud is not drawn too deeply into the hydraulic cylinder. To remove the apparatus 10 from the tube 58 to be worked, a wrench can be placed on areas 64 for attachment of a removal device. For example, a wrench may be placed on flattened areas 64 on the stud 12 and turned to effect the loosening of contact between the jaws 36 and the tube 58.

In another embodiment, the stud 12 is attached at its near end 14 to a two-way hydraulic cylinder. Spacers may be used in this embodiment as described above. Also as described above, the sleeve 48 is drawn toward the mandrel 20 as the two-way hydraulic cylinder draws in the stud 12. However, the two-way hydraulic cylinder allows hydraulic pressure to push the mandrel 20 away from the sleeve 48, thereby loosening the jaws 36 from the tube 58 after the groove has been formed. Thus, with a two-way hydraulic tube, an area 64 on the stud 12 for attachment of a removal device is not necessary.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An apparatus for making a groove on a pipe appropriate for a Victaulic-type coupling, comprising:

means for holding a pipe;

a plurality of separate jawed means for grooving a pipe at a distance from an end of a pipe;

means for pivotably attaching the plurality of separate means for grooving a pipe to the means for holding a pipe; and means for compressing the plurality of separate means for grooving a pipe to form a groove.

2. An apparatus for making a groove on a tube appropriate for a Victaulic-type coupling, comprising:

a stud member including a partitioning ring around the central region of the stud;

a mandrel, including:

a central interior bore complementary to the stud member;

a near end;

a central portion, comprising:

a diameter greater than or equal to the outside diameter of a tube to be worked; and e a resting area for the tube to be worked; and a far end with a diameter less than the inside diameter of the tube to be worked;

a plurality of separate, inwardly closing jaws, wherein each jaw includes:

a near end in complementary pivotable contact with the near end of the mandrel; and a far end with a flange for grooving the tube to be worked;

an outer tapered sleeve, comprising:

an inner diameter tapered toward a near end so that the outer tapered sleeve engages the jaws; and a central bore complementary to the stud; and a tightening mechanism complementary to the stud, whereby tightening of the mechanism draws the flanges on the jaws to the tube to be worked.

* * * * *